United States Patent [19]

Jacobson et al.

[11] Patent Number: 4,951,855

[45] Date of Patent: Aug. 28, 1990

[54] COUNTER STRESS BEAM HANGERS

[75] Inventors: Jeff A. Jacobson, Corona Del Mar, Calif.; James R. Duffield, Dana Point, Calif.

[73] Assignee: Jeffrey A. Jacobson, Corona Del Mar, Calif.

[21] Appl. No.: 395,267

[22] Filed: Aug. 17, 1989

[51] Int. Cl.[5] ..... A47G 25/16; A47G 25/36; A47G 25/48

[52] U.S. Cl. ..... 223/88; 223/92; 223/96

[58] Field of Search ..... 223/61, 69, 85, 87, 223/88, 89, 90, 91, 92, 93, 94, 95, 96; 248/317, 339, 340

[56] References Cited

U.S. PATENT DOCUMENTS

| | | | |
|---|---|---|---|
| D. 146,262 | 1/1947 | Mack | 223/91 X |
| D. 158,922 | 6/1950 | Zalonis | 223/92 X |
| D. 165,988 | 2/1952 | Kupchik | 223/92 X |
| D. 204,176 | 3/1966 | Zuckerman | 223/88 X |
| 1,331,886 | 2/1920 | Teske | 223/69 |
| 2,678,149 | 5/1954 | Walther | 223/92 |
| 2,895,657 | 7/1959 | Laughton | 223/92 |
| 2,912,149 | 11/1959 | Stuard | 223/92 |
| 3,165,245 | 1/1965 | Levine et al. | 223/91 |
| 3,923,213 | 12/1975 | George et al. | 223/96 |
| 4,221,310 | 9/1980 | Hazenveld | 223/94 |
| 4,416,401 | 11/1983 | King | 223/92 |
| 4,438,874 | 3/1984 | Zuckerman et al. | 223/91 X |
| 4,600,132 | 7/1986 | Blanchard | 223/95 |
| 4,607,771 | 8/1986 | Massion | 223/91 |
| 4,623,079 | 11/1986 | Tendrup | 223/85 |

FOREIGN PATENT DOCUMENTS

| | | | |
|---|---|---|---|
| 2181045 | 4/1987 | United Kingdom | 223/96 |

*Primary Examiner*—Werner H. Schroeder
*Assistant Examiner*—David K. Suto
*Attorney, Agent, or Firm*—Poms, Smith, Lande & Rose

[57] ABSTRACT

Hangers for hanging clothes or the like having a plastic main body portion and an integral plastic hook portion. The hanger main body portion has a plurality of cut-out areas formed by intersecting cross-beams with a continuous main arced counter stress cross-beam thereacross. In this manner, all of the stresses acting on the hanger are distributed evently throughout the arc formed by the continuous cross-beam and supported by the vertical or angular support beams attached thereto.

37 Claims, 6 Drawing Sheets

50
12
13
20
11
42
16
42a
41
41a
40
40a
39
39a
18
17
43a
49
15
14
19
19a
19b
37
36
33
350
35
340
34
-360-
23
32
510
58
53
55
57
570
51
28
240'
26
52
520
54
56
59
60
600
29
250'
27
43
R1
46
R2
48
a
44
47
230
23
45
R3

230
23''

106
105
230
23'
104

89
91
95
103
93
86
102
13
19b
22
20
85
42a
11
17
42
43a
15
37
101
35
41
41a
16
100
34
40
49
99
87
40a
39
18
98
39a
36
14
23
19
97
19a
96
21
92
90
94
88

XII
XII

COUNTER STRESS BEAM HANGERS

BACKGROUND OF THE INVENTION

1. Field of the Invention

The invention relates to hangers; and, more particularly, to clothes hangers having a hook for suspending the hanger and a main body portion from which the clothes are suspended.

2. Description of the Prior Art

Many different types of hangers are known in the art but all are designed the same and it is usually taken for granted that this primitive design cannot be improved. These hangers are made of various materials, such as wire, plastic, etc. Millions of such hangers are used in the commercial cleaning and laundry art, in the transport and warehousing of newly fabricated garments, in retailing garments, and the in-home use of hanging one's wardrobe. Thus, it is critical that such hangers be relatively inexpensive yet sturdy enough to support garments thereon without sagging or drooping as well as being substantially thin so as to accommodate the minimal areas available on preexisting racks in stores, warehouses, closets or the like. For these reasons, the majority of such hangers used in the commercial cleaning and laundry industry, are of thin wire bent into a shape having a hook at top and a main body portion from which the clothes are suspended. However, such wire hangers cannot be used to hang wet garments or hang clothes in humid climates since the wire rusts. These hangers also bend under the weight of certain garments and the ends of such wire hangers are dangerous. They also have a small cross-sectional radius which creases pants and shirts. They tangle easily, are not aesthetically pleasing and are usually thrown away rather than reused.

For these reasons, plastic hangers have been suggested. However, such hangers, as, for example, polypropylene hoop-type and polystyrene I-Beam-type hangers, are more expensive than the wire type and thus are not in general use in the commercial laundry industry. Current designs of plastic hangers require a considerable amount of plastic as well as processing time and are not as light in weight as wire hangers. One of the reasons is that all such hangers have a straight cross-beam which thereby requires considerable weight of material to function properly. They are also brittle and weak. This adds considerably to the cost of such hangers in both their manufacture and shipping costs. The wide dimensions of these prior art plastic hangers are prohibitive considering the limited storage space on dry cleaning racks and the like. In the clothing manufacturing and distribution industry, garments are transported and warehoused prior to distribution on plastic hangers made of polystyrene as opposed to wire hangers used in the dry cleaning and laundering industry. Polystyrene is used because it is inexpensive, light, and stiff; however, it is also brittle and requires thick sections to hold the weight to a garment. There is an industry complaint regarding such plastic hangers as constantly breaking, the thick hanger dimensions limiting their warehouse space, and the lack of hanger strength causing garments to droop.

There thus exists a need for a hanger which is inexpensive to manufacture, thin, aesthetically pleasing and reusable. Such hanger should be light in weight, nonbrittle and sufficiently inexpensive to manufacture and ship so as to be able to compete with wire hangers used in the commercial laundry and cleaning industry as well as plastic hangers used in the clothing manufacturing industry. Such hangers should be sufficiently aesthetically pleasing so as to be sold at the retail level for home use and pleasing enough to the owner so as not to be discarded when retrieved from the dry cleaners or laundry and re-used at home. It is also desirable that such a hanger use as little plastic material as possible and be as thin as possible yet provide great strength and support without dangerous sharp points and also be able to accommodate advertising thereon, different colors, etc. The foregoing should be accomplished using materials that do not rust and possess hanger dimensions maintaining the shape of a pressed shirt while eliminating bunching of the shirt front while reducing tangling, weight, storage and shipping costs.

SUMMARY OF THE INVENTION

It is an object of this invention to provide an improved light weight plastic clothes hanger for hanging garments.

It is a further object of this invention to provide a clothes hanger of plastic material having a unique counter stress beam thereacross for allowing all of the stresses acting on the hanger to be distributed evenly throughout the arc formed by the counter stress beam and supported by the vertical or angular support beams attached thereto.

It is still further an object of this invention to provide such a clothes hanger having an open framework, the struts forming the framework being of a cross-section to resist twisting.

It is also an object of this invention to provide such a hanger having a thickness or third dimension of a wider cross-section along a substantial part of the center of the counter stress beam to resist twisting.

These and other objects are preferably accomplished by providing hangers having a plastic main body portion and an integral plastic hook portion. The hanger main body portion has a plurality of cut-out areas formed by intersecting cross-beams with a main arced cross-beam thereacross. In this manner, all of the stresses acting on the hanger are distributed evenly throughout the arc formed by the continuous arced cross-beam and are supported by the vertical or angular support beams attached thereto. The open framework of the main body portion is formed by cross-beams that may have a cross-section that resists twisting. The hook portion may be coupled to the main body portion by an intermediate area in which advertising or logos may be imprinted or placed. Various embodiments of such hangers may be provided for retaining various items of clothing.

DESCRIPTION OF THE PREFERRED EMBODIMENTS

Figures 1, 8, 9, 10:
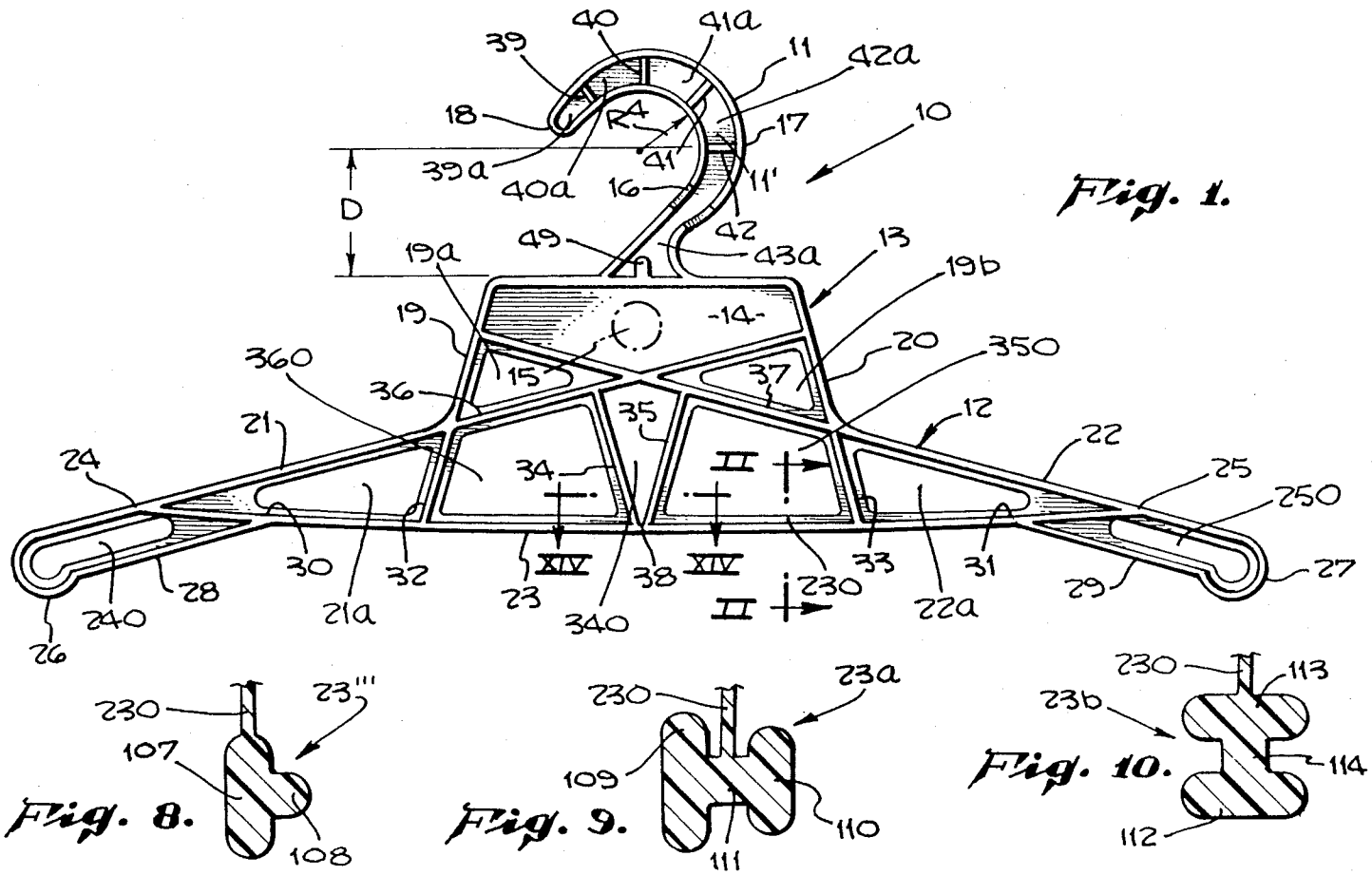
FIG. 1 is a vertical view of a preferred hanger in accordance with the teachings of the invention.
FIG. 6 to 10 are views similar to FIG. 2 illustrating various cross-sections for the hangers of FIGS. 1 to 5.

Referring now to FIG. 1 of the drawing, hanger 10 is shown having a hook portion 11 interconnected to main body portion 12 by an intermediate portion 13. Except for intermediate portion 13, which may have a solid planar midsection 14, where a logo 15 or other design or advertising information may be imprinted, and the intermediate areas of hook portion 11, as will be discussed, the hanger 10 has a substantially open framework. This framework is formed by spaced curved structural members 16, 17 meeting at one end at tip 18 and, at their other ends, blending or merging into side struts 19, 20. Struts 19, 20 merge or blend into slanted struts 21, 22, respectively, forming the upper edges of main body portion 12. A main arced counter stress beam 23 interconnects struts 21, 22. The struts 21, 22 continue past their point of connection (points 24, 25, respectively), then curve at their terminal curved ends 26, 27, respectively, back around to bottom struts 28, 29, respectively. These struts 28, 29 merge into main stress beam 23 at points 30, 31, respectively.

A plurality of intermediate struts interconnect the foregoing beam, struts and members to provide a strong yet substantially open framework. Thus, intermediate struts 32, 33 interconnect beam 23 to the point of intersection of struts 19, 21, on one hand, and the point of intersection of struts 20, 22, on the other hand. A pair of angled struts 34, 35 interconnect beam 23 to cross-struts 36, 37, respectively. As seen in FIG. 1, struts 34, 35 intersect at generally the midpoint 38 of beam 23 and each angles upwardly and outwardly to intersect its respective strut 36, 37. Struts 36, 37 cross and merge into struts 20, 19, respectively, at generally the middle thereof.

A plurality of spaced cross braces 39 to 42 interconnect structural members 16, 17. The areas 39*a* through 43*a* may be planar providing webbing for hanger 10. Also, generally webbing may be provided as shown surrounding open areas 19*a* and 19*b* adjacent struts 19, 20, respectively. Webbing may also surround open areas 21*a* and 22*a* between struts 21, 32, cross-beam 23, on one hand and struts 22, 33 and cross-beam 23 on the other. The area 340 between struts 34, 35 may be open and webbing may surround open areas 240, 250 and open areas 350 and 360 as shown.

Thus, a hanger 10 is formed having a substantially open framework formed by the intersection of beam 23 and the various struts, webbings, braces and members. Of course, planar midsection 14 could be eliminated so that the midsection 14 is also open.

Figures 2, 3:
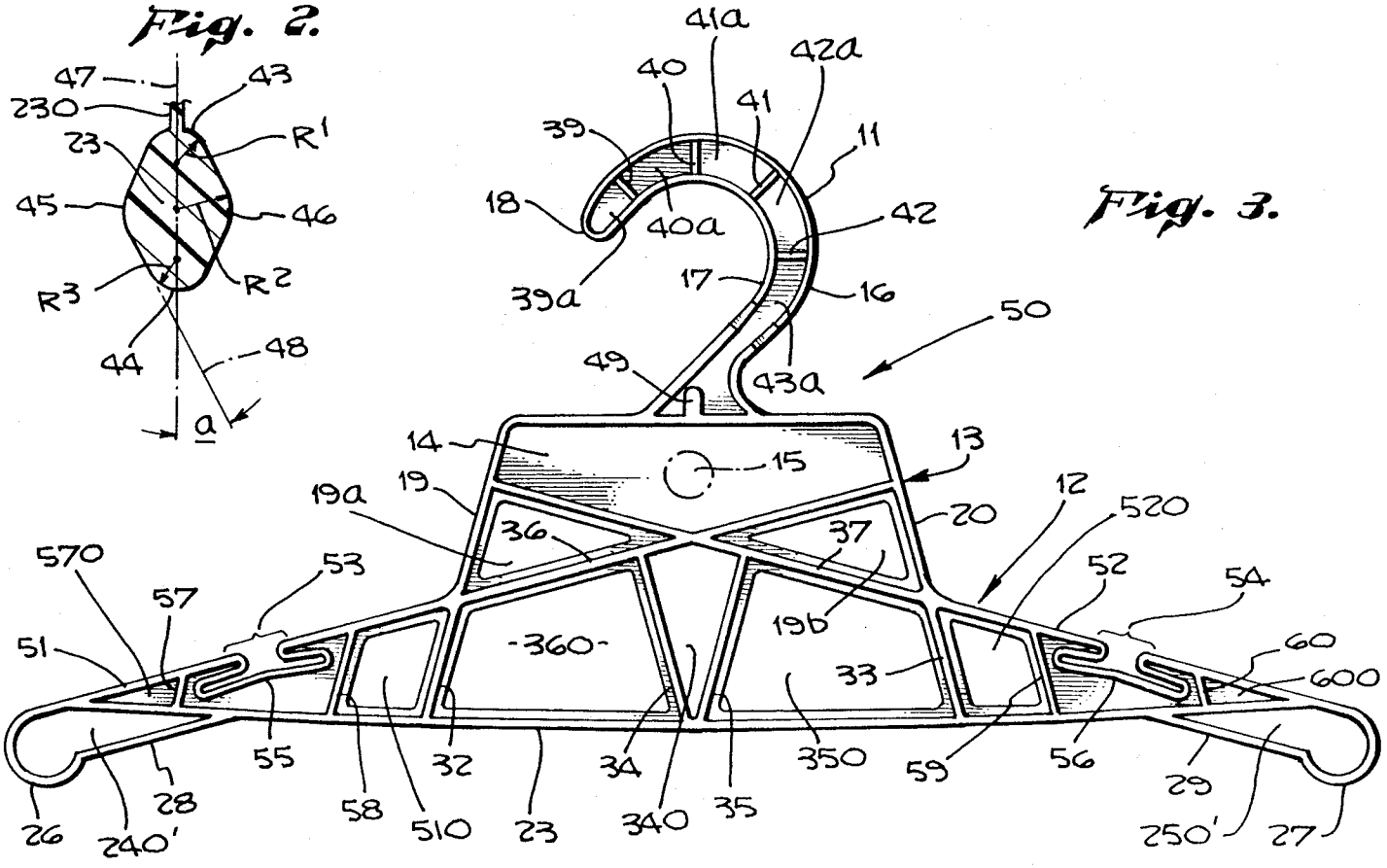
FIG. 2 is a view taken along lines II—II of FIG. 1.
FIG. 3 is a vertical view of a second embodiment of a hanger in accordance with the teachings of the invention.

As seen in FIG. 2, the cross-section of beam 23 is generally diamond-shaped (webbing 230 extending from beam 23). Such a shape is preferred to resist twisting This cross-section may be identical to the cross-section of all of the struts, braces and members forming hanger 10 (however, if desired, certain portions may be of the I-beam type in cross-section, particularly in hook portion 11). Although such diamond-shaped cross-section can be formed in various ways, as seen in FIG. 2, the cross-section of beam 23 has upper and lower curved ends 43, 44, respectively, merging into slightly arcuate sides 45, 46.

Although hanger 10 may be of any suitable dimensions, one preferred hanger, as hanger 10 in FIG. 1, is about 18" wide and about 8" high With such preferred dimensions, the cross-section of the beam, as seen in FIG. 2, may be about 0.160" high and about 0.100" thick. It can also be seen that, using an imaginary central axis 47, line 48 (tangential to and forming the sides of the beam 23) makes an angle a of about 23' 34' 41" with respect to axis 47. The radius $R^1$ may be about 0.030", the radius $R^2$ may be about 0.050" and the radius $R^3$ may about 0.030 inches. A mold tab 49 may be formed in each area 43*a*.

The overall height of hook portion 11 may be about 3.213" and the overall width may be about 2.736". Although the remaining dimensions discussed with regard to FIG. 2 may be the same for the struts, beams and members forming hook portion 11, its overall thickness may be less, such as 0.006 inches. As seen in FIG. 1, distance D may be about 1.875" and $R^4$ may be about 0.875". Planar midsection 14 may be about 0.020" thick. The logo 15 may be raised or imprinted and the hanger 10 may be provided in various colors.

Figure 14:
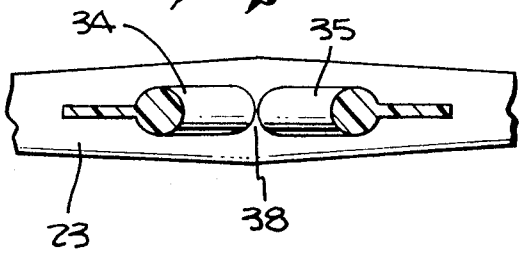
FIG. 14 is a view taken along lines XIV—XIV of FIG. 1.

As seen in FIG. 14, cross-beam 23 may be thicker or wider at the middle and tapered away outwardly therefrom as seen.

As seen in FIG. 3, wherein like numerals refer to like parts of the hanger 10 of FIGS. 1 and 2, hanger 50 is shown wherein struts 21, 22 have been replaced by struts 51, 52, respectively. Each strut 51, 52 merges from its respective end 26, 27 to struts 19, 20, respectively. At approximately the middle of each strut 51, 52, the strut is broken and the gap 53, 54, respectively, is interconnected by an inwardly curved open oval-shaped member 55, 56, respectively. A plurality of cross-struts 57, 58 on each side of member 55 provide strength to hanger 50 thereat In like manner, a plurality of cross-struts 59, 60 on each side of member 56 provide strength to hanger 50 thereat. In hanger 50, the areas 240', 250' at ends 26, 27 may be open and areas 510 and 520, between struts 58, 32 on one hand and struts 33, 59 on the other may be open surrounded by webbing. The areas between struts 59 and 60, and between struts 58 and 57 may be solid as may be the triangularly shaped end section 570 and 600 at ends 26, 27 (adjacent beam 23).

Thus, the gaps 53, 54 can be used to hook in straps or garments or the like or merely to hang clothes. The overall length of hanger 50 may be about 16" and the remaining dimensions may be identical to the dimensions of hanger 10. Hangers 10 and 50 may be used as conventional shirt hangers. The cross-section of the hanger 50 may also be identical to that of hanger 10 as discussed hereinabove with respect to FIGS. 1 and 2. The overall width of hangers 10 and 50 may of course vary, e.g., between 13 and 18 inches, depending upon the size and type of garments to be hung.

One particular type of hanger known in the art and used in the commercial industry, as for example in the clothing industry, is known as the trunk hanger. One such hanger is shown in FIG. 4 wherein again like numerals refer to like parts of the embodiment of FIGS. 1 and 2. Thus, hanger 61, which may be between about 7.85 to 11.1 inches in overall length to accommodate small and large sized trunks, includes a main body portion 62 having an elongated main linear cross-beam 63 and an arced counter stress beam 64 spaced from beam 63. Planar midsection 14 is now located in the middle of main body portion 62 and a pair of side sections 65, 66 are provided at each end of hanger 61. Each side section is defined at the top by a continuation of cross-beam 63 (portions 67, 68 respectively) spaced from a linear cross-beam 69, 70, respectively, the latter intersecting with stress beam 64 to form a continuation thereof. Each side section 65, 66 also includes a pair of downwardly extending spaced vertical struts 71, 72, each extending outwardly and horizontally at the bottom, then downwardly merging into generally V-shaped tab 73. Each side section 65, 66 is further defined by spaced downwardly extending struts 74, 75 on each side of struts 71, 72 (strut 75 extending first downwardly and outwardly at an angle from top portions 67, 68, then straight downwardly as shown—strut 74 curving straight downwardly from the terminal end of portions 67, 68). A U-shaped flange 76 is integral with struts 74, 75, extending downwardly from cross-beams 69, 70, and a pair of L-shaped strengthening ribs 77, 78 are provided on each flange 76 as shown. Finally, a plurality of cross-braces 79, 80 interconnect beam 63 to beam 64 on one side of midsection 14 and a plurality of cross-braces 81, 82 interconnect beam 63 to beam 64 on the other side of midsection 14. Angled cross-ribs 83, 84 define the sides of midsection 14 also interconnecting beam 63 to beam 64. The intermediate areas between all struts and ribs and cross-beams (except the areas surrounding struts 71, 72 and portion 73 forming the tabs) may be solid or of a thin webbing.

Struts 71, 72 and portion 73 extend normally slightly beyond the plane of the remainder of side sections 65, 66, as is well-known in the art, and are resiliently hinged, as is also well-known in the art, to allow for insertion of clothing, such as trunks, therein, and retention on hanger 61. A shirt or the like can then be hung over the top of beam 63 and side sections 65, 66. Again, the dimensions of hanger 61 and cross-section may be similar to those of hanger 10.

As seen in FIG. 5, where again like numerals refer to like parts of the hangers of FIGS. 1 to 4, hanger 85 has a hook portion 11, a main body portion 86 and a midportion 13. Main body portion 86 is quite similar to main body portion 12 of hanger 10 but has provisions for a removable round tube 87, such as cardboard or plastic. Such tubes are used to hang pants or the like thereon to avoid creasing. Thus, main body portion 86 has struts 21, 22 curving at each end 88, 89, respectively, and upwardly extending ribs 90, 91, respectively, connecting to struts 21, 22, respectively. Struts 92, 93 extend from ends 88, 89, respectively to stress beam 23. Projections 94, 95 extend inwardly from each end 88, 89 a short distance, each projection being aligned along a linear axis with the other projection, for receipt of a hollow tube 87 thereon (tube 87 is sufficiently flexible to allow for some bending or arcing for insertion of the projections 94, 95 into the open ends of tube 87 as is well-known in the art). A plurality of cross-braces, such as cross-braces 96 to 99, may be provided interconnecting beam 23 to struts 21, 36 and 34, as shown, on one side of struts 34, 35 whereas like cross-braces 100 to 103 may be provided interconnecting beam 23 to struts 86, 37 and 35 as shown. Hanger 85 may be about 17.88" in overall length with tube 87 being about 16" in overall length. The dimensions and cross-section of hanger 85 may be identical, where applicable, to those of hanger 10. Also, if desired, webbing may be provided, as in the FIG. 1 embodiment, within the open areas of the hanger 86.

Figures 5, 6, 7:
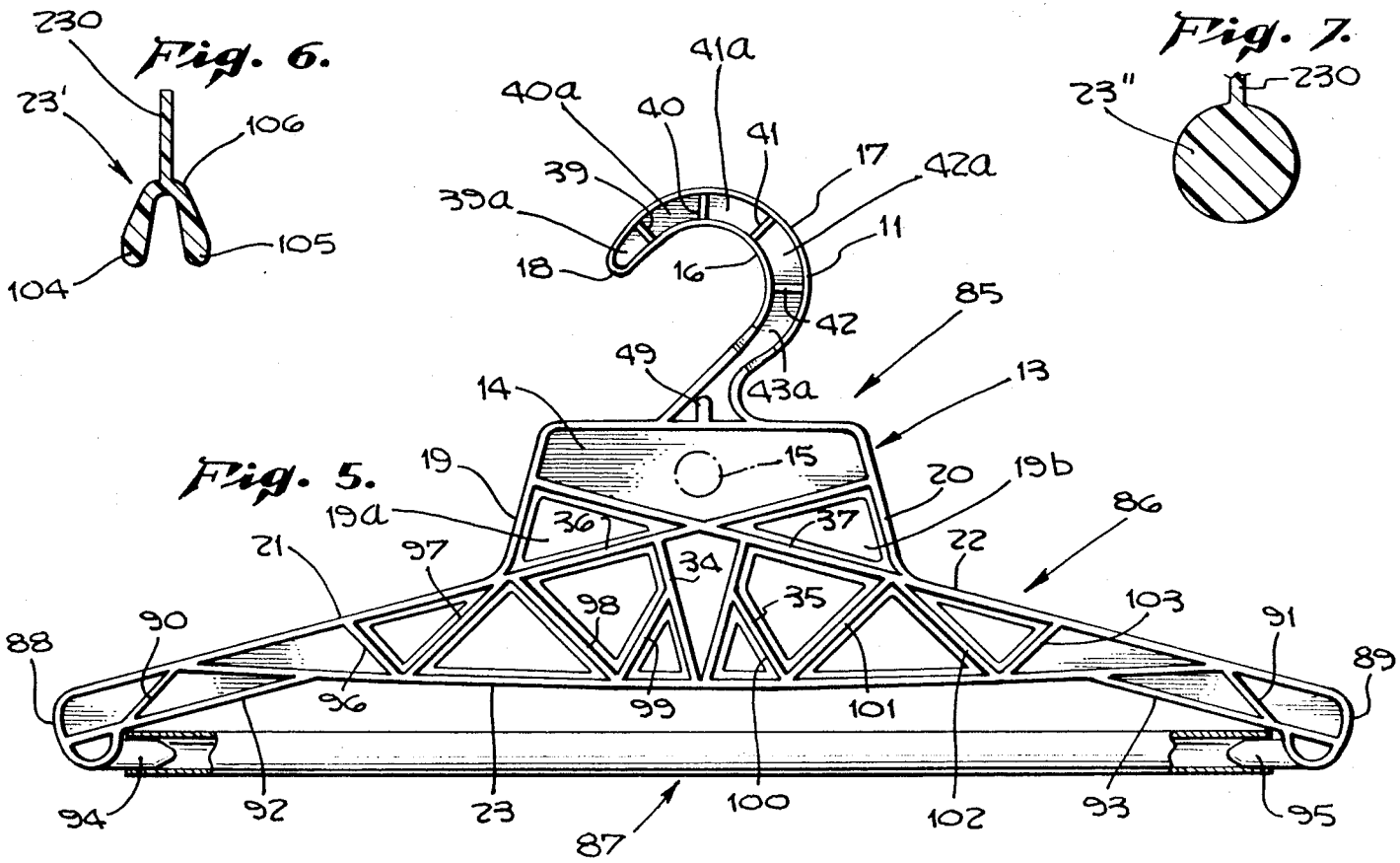
FIG. 5 is a vertical view of a fourth embodiment of a hanger in accordance with the teachings of the invention.

Although the diamond configured cross-section discussed hereinabove with respect to FIG. 2 is preferred in all embodiments to resist twisting, as seen in FIGS. 6 to 10, other cross-sections may be used. For example, as seen in FIG. 6, a U or V-shaped cross-section 23' (for at least beams 23 and 64) may be used. Such a cross-section may be about 0.108" long with the legs 104, 105 extending outwardly away from bight portion 106 and slightly enlarged, at their terminal ends, with respect to the remainder of the cross-section 23'.

As seen in FIG. 7, the cross-section 23" (for at least beams 23 and 64) may be round with a diameter of about 0.160". As seen in FIG. 8, cross-section 23''' (for at least beam 23 and 64) may be T-shaped having an elongated top 107 and a shorter leg 108 with rounded ends. Top 107 may be about 0.160 inches long and the leg 108 (together with the thickness of top 107) may be about 0.110" long. The rounded ends may have a radius of about 0.030".

Instead of a Tee-shaped cross-section, as seen in FIGS. 9 and 10, cross-sections 23 *a* and 23 *b* (for at least beams 23 and 64) may be H-shaped. Cross-section 23 *a* may have a top 109, a bottom 110 and an interconnecting section 111. Top 109 may be longer than bottom 110. As seen in FIG. 10, top 112 is connected to bottom 113 by midsection 114, top 112 being generally the same length as bottom 114. The overall thickness of cross-sections 23 *a* and 23 *b* may be about 0.110" and the ends may all be rounded, as by a radius of curvature of about 0.030".

Figures 11, 12, 13:
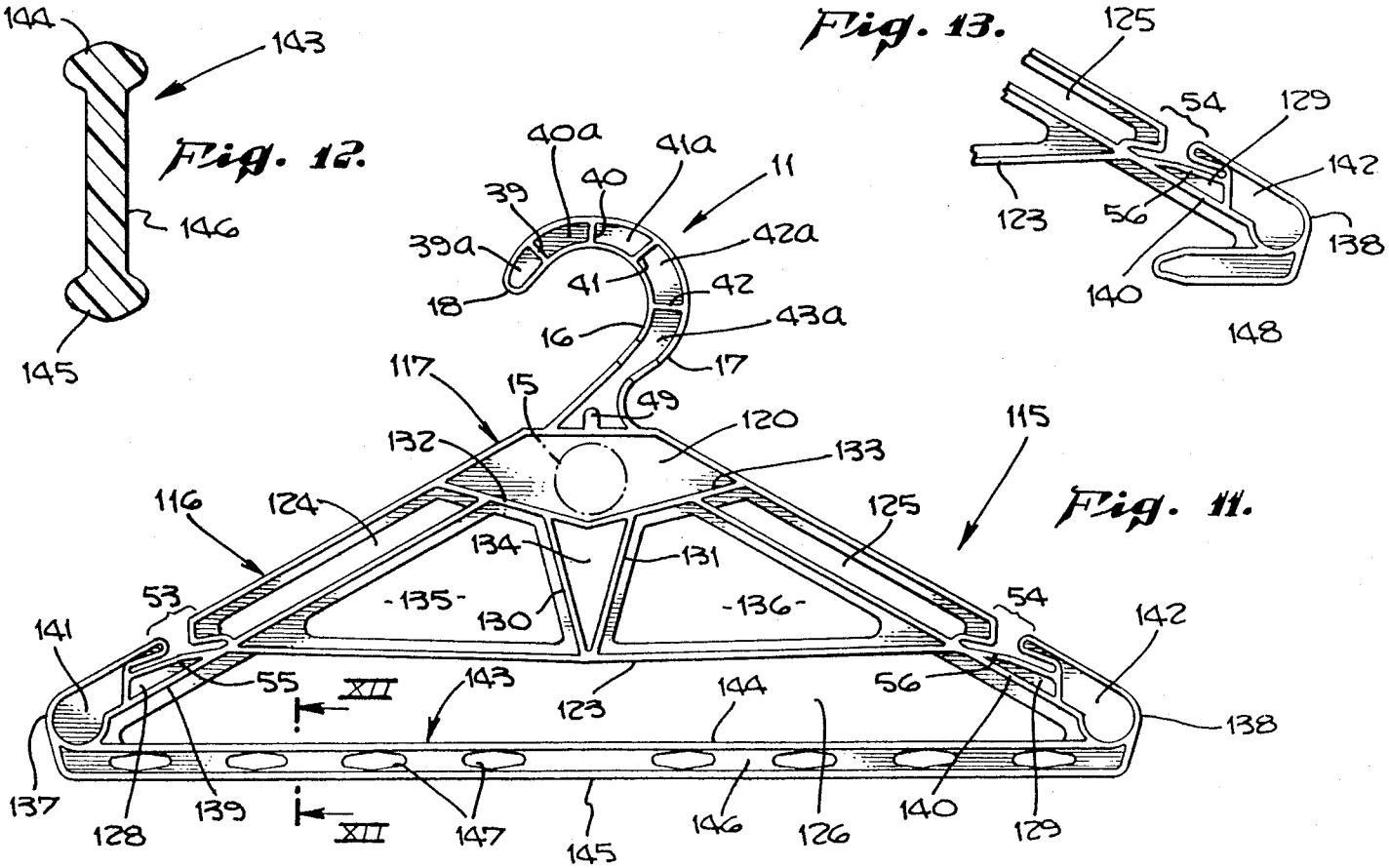
FIG. 11 is a vertical view of a fifth embodiment of a hanger in accordance with the teachings of the invention.
FIG. 12 is a view taken along lines XII—XII of FIG. 11.
FIG. 13 is a vertical view of a portion of a sixth embodiment of a hanger similar to that of FIG. 11.

As seen in FIG. 11, wherein again like numerals refer to like parts of the hangers of FIGS. 1 to 4, hanger 115 has a hook portion 11, a main body portion 116 and a midportion 117. Midportion 117 has a solid area 120. Main body portion 116 has an arced main counter stress beam 123 (similar to beam 23) with a pair of spaced open generally rectangular areas 124, 125. A pair of central struts 130, 131 form a vee (from beam 123 upwardly to cross-beams 132, 133 which meet in a V-shape as shown and form the bottom of midportion 117). The area within the vee shaped area 134 formed by struts 130, 131 is open as are the areas 135, 136 on each side of area 134. As seen, the beam 123 extends across the entire hanger 115 terminating at each end in rounded ends 137, 138, respectively. These rounded ends curve up and back, via struts 139, 140, respectively, to beam 123. The end areas 141, 142 so formed may be webbed. A bottom cross-beam 143 is formed by upper and lower spaced cross-struts 144, 145 interconnected by web 146. The area 126 between beam 123 and cross-strut 144 may be open. The struts 144, 145 merge into the respective ends 137, 138, as shown, and a plurality of irregularly shaped oblong-like spaced cut-out areas 147 are provided. As seen in FIG. 12, cross-beam 143 is bone-like in cross-section. Hanger 115 can be used to hang shirts. However, as seen in FIG. 13, a portion of the right side of hanger 115 of FIG. 11 is shown. In this embodiment, like numerals referring to like parts of the hanger of FIG. 11, cross-beam 143 has been replaced by inwardly extending projections 148 (only the right projection being shown) similar to projections 93, 94 of the hanger 85 of FIG. 5 for receiving a round cardboard tube 87 thereon as heretofore discussed. Also, the hanger 115 of FIG. 11 may have gaps 53, 54 and related structure, as in the FIG. 3 embodiment, for hanging straps or the like. Also, the triangular areas 128, 129 below members 55, 56 may be webbed as shown as well as surrounding open areas 124, 135, 134, 136, 125 and 126.

The cross-section of the various cross-beams may be of any of the aforementioned configurations of FIGS. 6 to 10. The overall length of hanger 115 may be about 18". The dimensions may be otherwise similar to the dimensions of the hangers of FIGS. 1 to 4.

Figure 15:
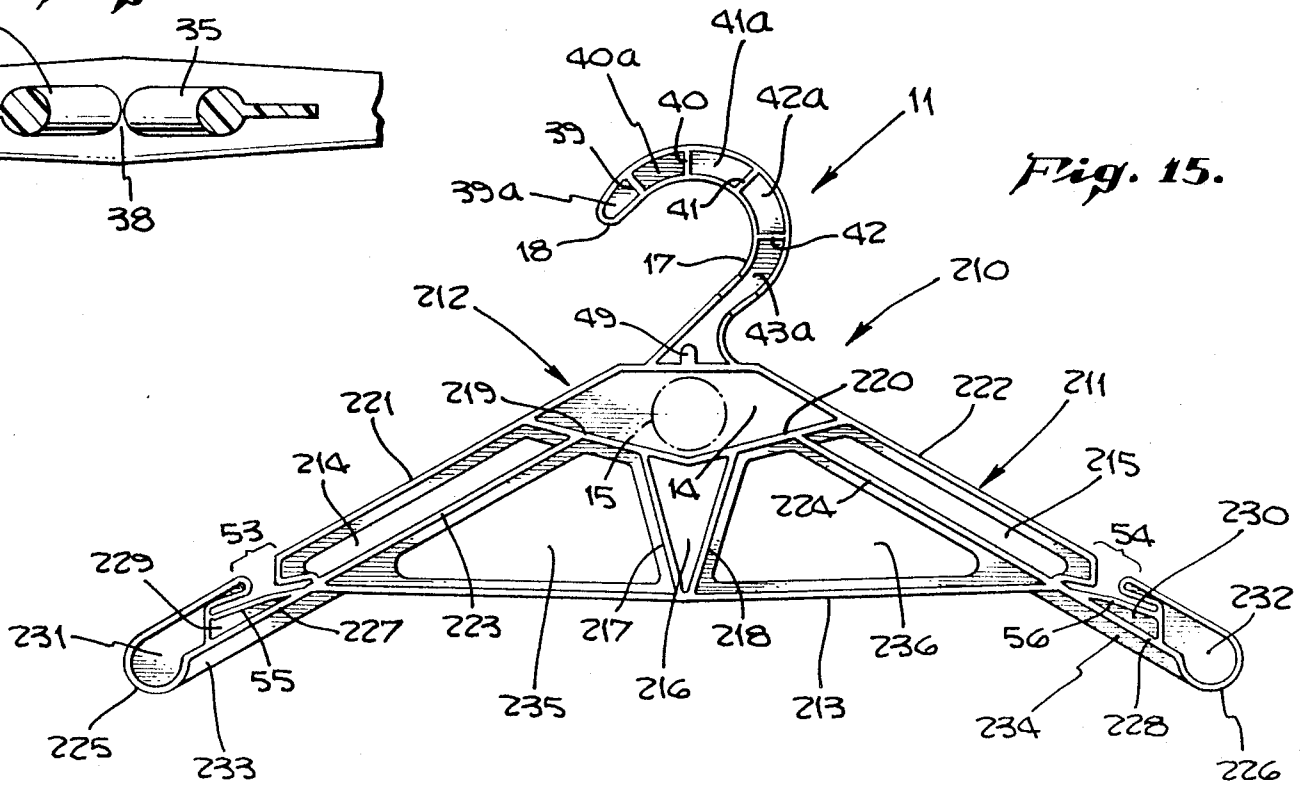
FIG. 15 is a vertical view of a seventh embodiment of a hanger in accordance with the invention.

As seen in FIG. 15, where again like numerals refer to like parts of the hangers of FIGS. 1 to 4, hanger 210 has a hook portion 11, a main body portion 211 and a mid-portion 212. Main body portion 211 has an arced main counter stress beam 213 (similar to beam 23) with a pair of spaced open generally rectangular areas 214, 215, respectively, on each side of a central area 216 defined by struts 217, 218, respectively, extending upwardly generally from the midpoint of cross-beam 213 and forming a Vee (the upper ends of struts 217, 218 intersecting struts 219, 220, respectively the latter forming the bottom of area 14 and also forming a Vee at their intersection). Rectangular areas 214, 215 are defined by outer struts 221, 222, respectively, spaced from respective inner struts 223, 224, respectively. The outer struts 221, 222 each have gaps 53, 54 and members 55, 56 as in the embodiments of FIG. 3 for holding straps or the like. The curved ends 225, 226, respectively, curve upwardly via struts 227, 228, respectively, to cross-beam 213. Triangular areas 229, 230, which may be webbed, are provided against members 55, 56, respectively, and the areas 231, 232 (adjacent ends 225, 226, respectively) may also be webbed. Webbing 233, 234 may be provided along struts 227, 228, respectively. Also, webbing may be provided surrounding open areas 214, 215, 235 and 236. Hanger 212 may be used to hang caps or the like and may also be of any suitable dimensions, such as 16" long, and may also have the various embodiments of cross-sections heretofore discussed.

It can be seen that all of the hanger embodiments have a unique counter stress beam (23, 64 or 123—with its continuations 69, 70) extending all the way across each hanger from one end to the other. If such beam were straight, the beam would snap, fold or crimp in use. Of course, a straight beam could be strengthened to hold more weight by adding many more intermediate cross-ribs or increasing the cross-section area; however, these ribs and increased cross-sections would add to the weight, cost, manufacturing problems, etc.

Any suitable radius of curvature for beams 23, 123 and 64 may be used. With the length dimensions given, a radius of curvature of about 100" may be used. Such dimensions provides a continuous downwardly bowed arc so that all of the stresses acting on the hanger go back to the center of the circle of the arc of the beam thus functioning as a counter stress beam.

Although various cross-sections have been disclosed in FIGS. 6 to 10, particularly for beams 23, 123 and 64, the diamond-shaped configuration is preferred. Such shape resists twisting and provides sufficient strength to the hangers with the least amount of weight. Such a configuration is as strong as a round configuration, as in FIG. 7, which is twice the volume. Thus, it saves on material and its unique shape counters torque or twisting.

The hangers herein can stack closer together in closets or the like, or on dry cleaning racks, or in shipping and warehousing. The hangers have half of the volume of conventional wire hangers and less weight without tangling. Conventional wire hangers are usually about 80 to 160 thousandth inches in diameter whereas hoop-type hangers are about ¼" to ⅜" in diameter. The hangers herein may be as low as 80 thousandth inches or less in diameter. Further, when conventional wire hangers are used for hanging trousers or the like, a doubled thickness is used so such hangers might be 160 to 320 thousandth inches in diameter. The hangers herein can be used on trousers without need for doubled thickness.

The hangers herein may all be injection molded from suitable plastic resin material, such as polyethylene or polypropylene. Polypropylene has a relatively stable price history and future stable price outlook and is thus preferred. The polypropylene may consist of a mixture of between about 12 and 25% fiberglass fibers for the purpose of adding rigidity and preventing warpage when under stress in warm temperatures. The edges are all rounded so there are no sharp edges to catch on clothing or cut one's fingers or the like.

In using conventional wire hangers to hang dresses or the like, paper is wrapped around to the wire hangers so that the wire doesn't scratch the dress or rust. No such paper inserts need be used with the hangers herein because several thin plastic struts are provided that can accept a pin around it.

It can be seen that the hangers herein can be manufactured more economically than conventional wire hangers and cost less for shipping. They can be stored without tangling and in less space, are waterproof and won't corrode. A separate inventory of paper inserts or the like is not necessary. The unique counter stress beam allows the area above the beam to have considerably less plastic and distributes the forces acting on the hanger so that these forces act on the ends.

The hangers herein are thus lighter than conventional hangers and use less material. Since polypropylene is used, the hangers can withstand heat up to 260° F. before the plastic material starts to flow or melt. Thus, T-shirts and the like may be steamed while disposed on the hanger without need for removal. Currently, garments are steamed on steel hangers and then must be re-hung on plastic hangers for shipping. The plastic material provides an inherent lubricating surface for sliding the hangers on poles or the like. The hanger material is not brittle nor affected by heat or UV light which causes the hanger to collapse under normal warehouse lighting.

Although the continuous arced counter stress cross-beams may be of uniform thickness therealong, each cross-beam 23, 64, 123 may be wider in the middle to prevent torquing or twisting, e.g., 160 thousandths of an inch thick, then thinning away from the center (as, for example, cross-beam 23 in FIG. 14—beams 64, 123 being similar). Each cross-beam 23, 64, 123 may also be about 260 thousandths of an inch thick at the middle and all webbing areas may be about 20 thousandths of an inch thick. This adds rigidity to the hangers where it is most needed but eliminates such added thickness and weight where it is not needed.

If conventional prior art hangers are injection molded from styrene, the styrene would snap in use as it is too brittle for the hangers proposed herein within those dimensions. Styrene is dangerous when it breaks since it is brittle and has sharp edges. It also breaks down during storage because of the normal heat in the warehouse and the U.V. exposure from the lighting. The plastic hangers disclosed herein provide the same strength as propylene hangers, such as hoop-type hangers, or solid I-beam type hangers, without the high cost since the hangers herein are structured in a way to achieve the same strength without the added weight and the time it takes to cure.

Since the hangers herein are lighter in weight than conventional hangers, they are cheaper to ship, lighter, take up less cubic space and use less petroleum materials thus contributing to the environment. The hangers of this invention are reusable since they are aesthetically pleasing to look at, strong, and won't rust or tangle. A retailer can keep the hanger on the garment that was shipped to him from the manufacturer and sell it as is. The consumer will thus take the garment and hanger home and keep it thus retaining the clothing manufacturer's logo or name on the hanger (or the retailer's) utilizing double the storage, in the same space as prior hangers had previously occupied.

Figure 4:
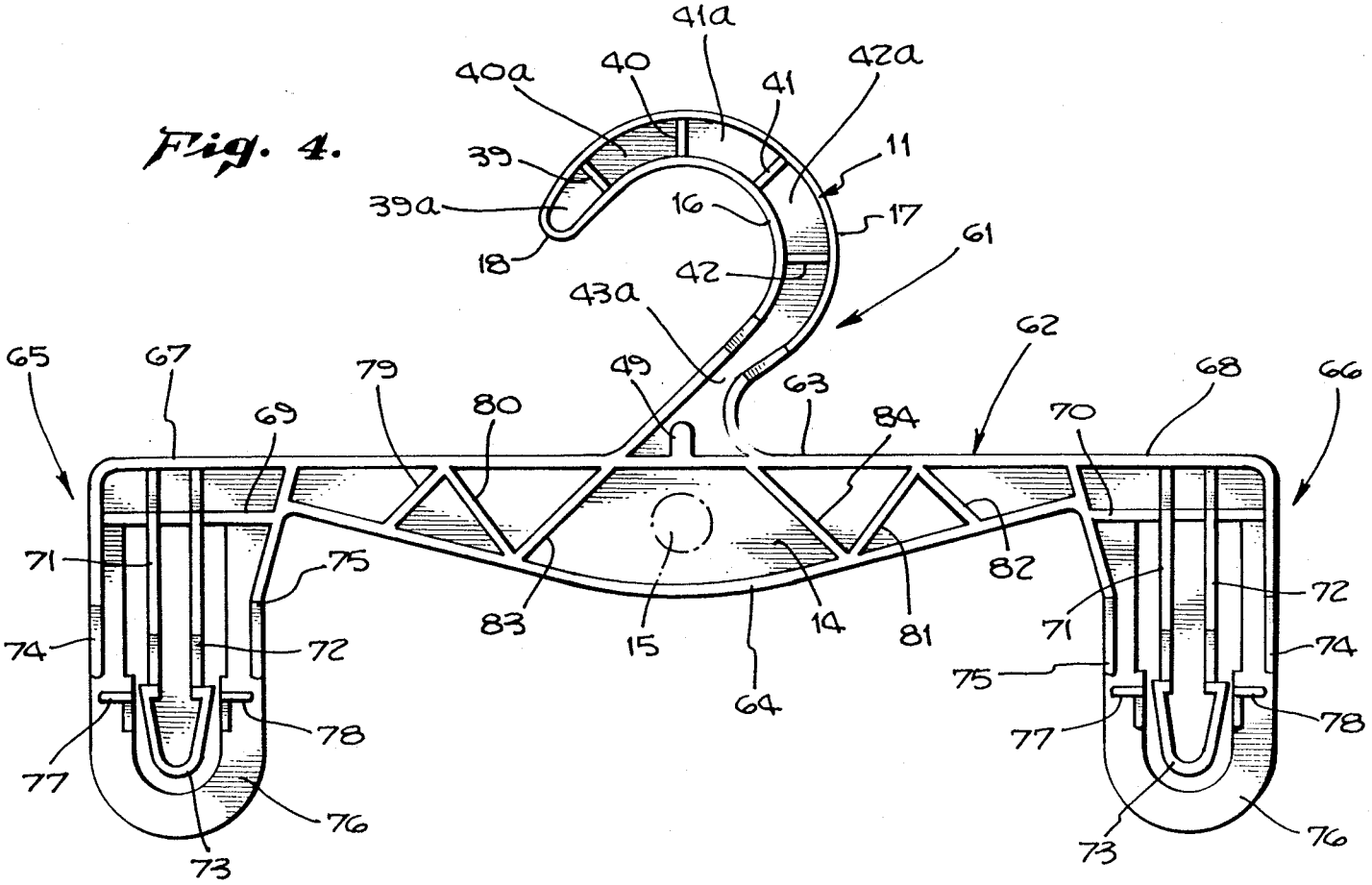
FIG. 4 is a vertical view of a third embodiment of a hanger in accordance with the teachings of the invention.

Conventional trunk-type hangers, of the type illustrated in FIG. 4 herein, have tabs (elements 71–73) which pull out for thick trunks. Since such prior art tabs are usually made of styrene, which has no memory, the tabs open up after a while and the trunk falls off. The tabs 71–73 of the hanger of FIG. 4 have a living hinge at ribs or beam 68, 70 and memory properties so that they do not open up and retain the trunks thereon.

It can be seen that the weight of the garment on each hanger is carried by the hook portion 11 and distributed throughout the beam structure (cross-beams 23, 64, 123). The cross-beams 23, 64, or 123 connecting the two struts 21, 22 are radially extending and are supported vertically by means of struts such as struts 34, 35, and or thin webbing areas, such as areas 19*a*, 19*b*, 14, 21*a* and 22*a* connecting the cross-beam and the annular struts 21, 22. The cross-beam 23, 64, 123 distributes the vertical forces along the radius of the arced counter stress beam in direct proportion to the cosine of the angle, thus counteracting the vertical forces exerted on the angular struts 21, 22 equally away from the ends where there is less plastic and toward the center. The center may be thicker, as illustrated in FIG. 14, thus providing plastic only where necessary for support. The beam cross-sectional shape is preferably diamond shaped. The diamond shape physically resists twisting and has a pleasing appearance.

The axial forces (twisting) encountered by the hangers in use may be countered by varying the cross-sectional dimensions of the various beams and struts, in particular, the radially extending cross beam cross-sectional width may be increased for approximately 75% of its length, starting at the center and equal distance from the center of the cross beam 23, 64, or 123.

If a conventional plastic hanger was made of the same plastic material as disclosed herein, such as polypropylene, but without an arced cross beam, as beam 23, it would collapse in use. That is, a straight cross beam hanger would collapse and kink under the same maximum load conditions encountered by the arced counter stress beam disclosed herein. The straight cross beam hanger must increase the mass of its cross-section throughout its supporting members to compensate for deficiency in strength as compared to the arced counter stress beam design. The cycle or actual injection molding cost as well as volume of material required would increase due to a longer curing time and increased weight of the straight beam design. The unique arced counter stress beam design utilizes its mass more efficiently than prior art designs due to its geometry of load transferring mechanics. For the first time, a hanger is molded in plastic, thin, inexpensive and strong enough to replace current designs in wire and plastic. The cost per cubic inch, for achieving the desired strength per cubic inch, is considerably less than in prior art hanger designs. The unique arced counter stress beam design is stronger and more efficient than the prior art hangers for the purpose of hanging clothes.

The weight of a garment on the hangers disclosed herein is transferred from the garment downward to the top struts 21, 22. Downward pressure on the hanger not only transfers the pressure back up, due to the arced beam but horizontally to the ends and up along the line of the arced counter stress beam 23, 64 or 123. This is centrally supported where the most support material may optionally be provided as seen in FIG. 14. The center "V" shaped supports 34, 35 push up to this central support where the downward forces are transferred to the arced counter stress beam 23, 64 or 123 connecting the two top struts 21, 22 which again distributes the forces evenly along the arc of the counter stress beam 23, 64 or 123. This transfers the weight into turning up the ends so that the structure pushes upon the outside and upward more than is pressed down. If the center of the hanger is made stronger than the rest, this helps to support the stresses coming from the outsides of the hanger where the least amount of plastic material is located. Additionally, the arced counter stress beam 23, 64 or 123 serves to transfer the forces evenly throughout the arc formed by the counter stress beam at a great than 1 to 1 ratio. Removing the center webbing but leaving a portion surrounding the opening between the various struts and beams results in a hanger structure which is just as strong as if these areas were solid.

Thus, the hangers herein are less expensive to manufacture over prior art hangers due to less weight and less molding cure time. Their modern aesthetically appealing look provides acceptance in dry cleaners, retail stores, manufacturing plants, and the home. They can be provided in designer colors and logos or other design or mark can be embossed at no charge because the logo, design or mark may be provided in the mold, and, thus, can easily be changed by just changing the insert to the mold cavity.

The hangers herein are thinner than current plastic designs and therefore more garments can be placed on the pole or rack in a plant or the like minimizing warehouse size. These hangers are also as thin as the wire hangers in normal use and therefore, for the first time a plastic hanger in accordance with the invention can be used in a dry cleaner or the like due to restricted hanging space in such establishments.

The improved hangers herein will not rust, and if bent, will flex back to heir original shape as opposed to wire hangers. They are not brittle like current polystyrene plastic prior art hanger designs. They are safe and have no sharp edges and won't penetrate one's skin. The hangers herein are safer than brittle styrene hangers that have glass-like sharp edges if broken. The hangers herein are safer than wire hangers with their pointed ends which are open and exposed. The hangers disclosed herein are unbreakable, reusable, have smooth surfaces and edges and hang properly. If made of polypropylene, such material has an inherent lubricity which allows it to slide on poles and racks easier and won't scratch off paint from wood, chrome or steel poles. The top or upper struts provide more gentle radius than the 0.080" crease than a conventional wire hanger leaves on a garment.

Clothing can be steamed directly on the hanger disclosed herein whereas styrene bends and folds at steam temperatures and wire rusts onto the clothing. The hangers disclosed herein are less expensive to ship and use less material in manufacture. Since they are thinner than current plastic hangers by less than ½, they therefore occupy less than ½ the storage space when in boxes or hanging. Such hangers as disclosed herein won't tangle like wire hangers, nor shuffles into stacks like playing cards. They hold the shoulders of a shirt hanging thereon high on each side as it is when the shirt is worn. Since a wire hanger must have a pyramidal shape in order to save wire and extra wire bending costs—causing the fabric to bunch in front because the shoulders droop and wrinkles occur when the hangers are bunched together—garments hung on hangers as disclosed herein look better and make the pressing look great.

If polypropylene is used, such material has a rebound memory whereas styrene does not. When polypropylene is bent, it will snap back to the original manufactured position, which is especially important for the trunk and shorts hangers as in FIG. 4. The clip in conventional styrene hangers does not provide equal clamping pressure on thick and thin garments and, after being clipped on a thick one, it becomes too loose for a thin one. Steel clips are cost prohibitive compared to the one piece plastic in which applicant's hangers can be made. Polypropylene maintains its shape even from heat and the U.V. light coming off the fluorescent lights in the warehouse. Conventional styrene hangers droop and cold flow and the clothing falls off the ends and the clips open up due to the heat and U.V. light in warehouses due to fluorescent lighting.

Polypropylene is also a stable priced item and has a stable future price due to an over abundance of U.S. manufacturing plants for it as compared with demand. Styrene and wire have been increasing in price in the last year. Clothing manufacturers can encourage the retailer to keep the clothing on the modern, strong, and aesthetically appealing, hangers disclosed herein while in their store and then pass it on with the sale (due to their low cost) thereby giving the consumer a re-usable hanger with the clothing companies name on it for re-use in the customer's closet. This will prevent the retailer from having to purchase hangers and they won't have to pay the added time of the employees required to re-hang the clothing from the manufacturer's hanger to the retailer's hanger. In conclusion, the above superior benefits are due to the design of the hangers herein and the automation of the manufacturing process, along with the knowledge of the latest in state of the art plastic injection molding technology—both in equipment and in low cost plastic materials and chemical additives.

I claim:

1. A hanger of a plastic material comprising:

a hook portion;

a main body portion, and an intermediate portion interconnecting the hook portion to the main body portion, said intermediate portion being connected to substantially a midpoint of said main body portion with said main body portion extending laterally outwardly from the midpoint thereof on both sides of said intermediate portion to form opposite terminal ends thereof, said main body portion being a substantially open framework formed by a plurality of intersecting ribs, said main body portion having a main elongated upwardly opening arced counter stress cross-beam extending from one terminal end to the other terminal end of said main body portion, said cross-beam having a cross-section adapted to resist twisting, the middle of said cross-beam being connected to said intermediate portion, and outside ends of said cross-beam being connected to said intermediate portion.

2. The hanger of claim 1 wherein said plastic material is an injection molded resin material.

3. The hanger of claim 2 wherein said plastic material is a polypropylene.

4. The hanger of claim 2 wherein said plastic material is a polymeric material.

5. The hanger of claim 1 wherein the cross-section of said beam is diamond-shaped.

6. The hanger of claim 1 wherein the cross-section of said beam is round.

7. The hanger of claim 1 wherein the cross-section of said beam is U-shaped.

8. The hanger of claim 7 wherein said cross-section has a curved bight portion and integral downwardly and outwardly extending spaced legs terminating in enlarged ends.

9. The hanger of claim 1 wherein the cross-section is T-shaped.

10. The hanger of claim 1 wherein the cross-section is H-shaped.

11. The hanger of claim 1 wherein said hook portion is comprised of a pair of spaced curved members meeting at a tip interconnected by a plurality of spaced cross-braces forming said hook portion.

12. The hanger of claim 11 including solid webbing areas between said cross-braces and said curved members.

13. The hanger of claim 11 including open areas encircled by webbing material between said cross-braces and said curved members.

14. The hanger of claim 11 wherein said members are I-shaped in cross-section.

15. The hanger of claim 14 wherein a design is imprinted on said planar sheet.

16. The hanger of claim 1 wherein said intermediate portion has a planar sheet therein.

17. The hanger of claim 1 wherein said main body portion includes a pair of struts, each of said struts having a first strut part extending outwardly and downwardly from opposite sides of said intermediate portion past points of connection outwardly of said cross-beam to said main body portion and curving inwardly at a point past the point of connection of said cross-beam to said main body portion to form a second strut part parallel to said first strut part and into connection with said cross-beam at a point spaced from the point of connection of said cross-beam to said main body portion thereby forming curved ends, said cross-beam at each terminal end thereof thereby intersecting each of said pair of first strut parts between the points of connection of said first strut parts to said intermediate portion and said curved ends.

18. The hanger of claim 17 including solid webbing areas between said pair of first strut parts and said cross-beam at their point of connection and on each side of said intermediate portion.

19. The hanger of claim 18 including openings (21*a*, 22*a*) in each of said solid webbing areas surrounded by webbing material.

20. The hanger of claim 17 wherein said ribs interconnect said cross-beam to said pair of first strut parts and said intermediate portion.

21. The hanger of claim 17 wherein a short horizontal projection extends inwardly toward the center axis of said hanger from each curved end, and a removable flexible hollow tube being disposed on said projections.

22. The hanger of claim 21 wherein said tube is of cardboard.

23. The hanger of claim 21 wherein said tube is of plastic.

24. The hanger of claim 1 wherein said cross-beam extends along a bottom of said intermediate portion forming the bottom thereof, said main body portion having a pair of generally rectangular side sections at each end of said cross-beam, said cross-beam terminating at each end in elongated cross-beams within each of said side sections.

25. The hanger of claim 24 wherein said main body portion has an elongated generally horizontal cross-beam extending from the intersection of said hook portion with said intermediate portion and spaced from said arced cross-beam, said ribs interconnecting said cross-beams, said horizontal cross-beam forming the upper portion of each of said side sections with each of said side sections, having a resilient extending downwardly tab extending slightly beyond a plane of the remainder of said side section.

26. The hanger of claim 1 wherein an overall length of said hanger is about 18" and a radius of curvature of the arc of said cross-beam is about 100".

27. The hanger of claim 26 wherein said cross-beam has a diamond-shaped cross-section.

28. The hanger of claim 1 wherein a second cross-beam is provided below said counter stress cross-beam coupled to the same, said second cross-beam being formed by a pair of spaced struts interconnected by a web with a plurality of spaced, cut-out areas formed through said web.

29. The hanger of claim 1 wherein a pair of inwardly extending projections for receiving a hollow tube thereon are provided below said cross-beam and connected thereto.

30. The hanger of claim 1 wherein the arced counter stress cross-beam is elongated and has a midportion, said cross-beam being thicker at the midportion thereof and tapering to a lesser thickness than at the midportion thereof away from the midportion thereof to prevent torquing and bending of said cross-beam.

31. The hanger of claim 30 wherein said cross-beam is about 160 thousands of an inch in height at the center thereof.

32. The hanger of claim 30 wherein said cross-beam is about 260 thousands of an inch thick at the center.

33. The hanger of claim 1 wherein said plastic material is a polymeric material consisting of a mixture of polymers and various fibers of fillers to enhance strength.

34. A hanger of a plastic material comprising:

a hook portion;

a main body portion, and an intermediate portion interconnecting the hook portion to the main body portion, said intermediate portion being connected to substantially a midpoint of said main body portion with said main body portion extending laterally outwardly from the midpoint thereof on both sides of said intermediate portion to form opposite terminal ends thereof, said main body portion being a substantially open framework formed by a plurality of intersecting ribs, said main body portion having a main elongated upwardly opening arced counter stress cross-beam extending from one terminal end to the other terminal end of said main body portion, said cross-beam having a cross-section adapted to resist twisting, the middle of said cross-beam being connected to said intermediate portion, and outside ends of said cross-beam being connected to said intermediate portion, said main body portion including a pair of struts, each of said struts having a first strut part extending outwardly and downwardly from opposite sides of said intermediate portion past a point of connection outwardly of said cross-beam to said main body portion and turning inwardly at a point past the point of connection of said cross-beam to said main body portion to form a second strut part extending parallel to said first strut part and into connection with said cross-beam at a point spaced from the point of connection of said cross-beam to said main body portion thereby forming turned ends, said cross-beam at each terminal end thereof thereby intersecting each of said pair of first strut parts between the points of connection of said first strut parts to said intermediate portion and said turned ends.

35. The hanger of claim 34 wherein said ribs interconnect said cross-beam to said pair of first strut parts and said intermediate portion.

36. The hanger of claim 34 including solid webbing areas between said pair of first strut parts and said cross-beam at their point of connection and on each side of said intermediate portion.

37. The hanger of claim 36 including openings (21*a*, 22*a* in each of said solid webbing areas surrounded by webbing material.

* * * * *

UNITED STATES PATENT AND TRADEMARK OFFICE

CERTIFICATE OF CORRECTION

PATENT NO. : 4,951,855

DATED : August 28, 1990

INVENTOR(S) : Jeff A. Jacobson and James R. Duffield

It is certified that error appears in the above-identified patent and that said Letters Patent is hereby corrected as shown below:

Claim 15 should be Claim 16 and Claim 16 should be Claim 15. Claim 16, as corrected, should depend from Claim 15.

Signed and Sealed this

Third Day of December, 1991

*Attest:*

HARRY F. MANBECK, JR.

*Attesting Officer*

*Commissioner of Patents and Trademarks*